US007819986B2

(12) United States Patent
Ryu et al.

(10) Patent No.: US 7,819,986 B2
(45) Date of Patent: Oct. 26, 2010

(54) DISH WASHING MACHINE WITH WATER LEVEL DETECTING UNIT

(75) Inventors: Jung Chan Ryu, Suwon-Si (KR); Shimotera Kennichi, Seoul (KR); Eui Soo Kim, Seoul (KR); Young Ho Kwon, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 720 days.

(21) Appl. No.: 11/645,713

(22) Filed: Dec. 27, 2006

(65) Prior Publication Data

US 2008/0011339 A1 Jan. 17, 2008

(30) Foreign Application Priority Data

Jul. 12, 2006 (KR) ..... 10-2006-0065597

(51) Int. Cl.
*B08B 3/00* (2006.01)

(52) U.S. Cl. ..... 134/56 D; 134/57 D; 134/58 D

(58) Field of Classification Search ..... 314/56 D, 314/57 D, 58 D
See application file for complete search history.

(56) References Cited

U.S. PATENT DOCUMENTS

2005/0126634 A1* 6/2005 Penteado et al. ..... 137/412
2005/0236020 A1* 10/2005 Bang ..... 134/56 D
2005/0241675 A1* 11/2005 Jung et al. ..... 134/18
2005/0263174 A1* 12/2005 Yoon et al. ..... 134/104.1
2005/0284506 A1 12/2005 Lee
2007/0131261 A1* 6/2007 Lee et al. ..... 134/112

FOREIGN PATENT DOCUMENTS

| | | | |
|---|---|---|---|
| EP | 947156 | A1 * | 10/1999 |
| JP | 4-309819 | | 11/1992 |
| JP | 04309819 | A * | 11/1992 |
| KR | 1991-0000410 | | 1/1991 |
| KR | 10-2005-0105720 | | 11/2005 |
| KR | 10-2005-0105721 | | 11/2005 |
| KR | 10-2005-0105722 | | 11/2005 |
| KR | 10-2005-0105723 | | 11/2005 |
| KR | 10-2005-0105724 | | 11/2005 |

OTHER PUBLICATIONS

Chinese Office Action for corresponding Chinese Application 200610172520.6; issued Jun. 26, 2009.

* cited by examiner

*Primary Examiner*—Michael Barr
*Assistant Examiner*—Charles W Kling
(74) *Attorney, Agent, or Firm*—Staas & Halsey LLP

(57) ABSTRACT

A dish washing machine in which water is supplied to a level detecting unit without sudden change of a flow rate and pressure of water from a water supplying unit to the level detecting unit such that the level detecting unit can precisely detect a level of water in the tub. The water supplying unit includes a first guide passage guiding the water to the tub, and a second guide passage guiding the water to the level detecting unit such that a portion of the water is supplied to the level detecting unit through the second guide passage. The water supplying unit includes a buffering space disposed between the second guide passage and the level detecting unit such that water flows from the water supplying unit to the level detecting unit at a predetermined flow rate.

5 Claims, 4 Drawing Sheets

DISH WASHING MACHINE WITH WATER LEVEL DETECTING UNIT

CROSS-REFERENCE TO RELATED APPLICATIONS

This application claims the benefit of Korean Patent Application No. 10-2006-0065597, filed on Jul. 12, 2006, in the Korean Intellectual Property Office, the disclosure of which is incorporated herein by reference.

BACKGROUND OF THE INVENTION

1. Field of the Invention

The present invention relates to a dish washing machine. More particularly, to a dish washing machine in which a water supplying unit and a level detecting unit are improved to precisely and rapidly detect a level of washing water.

2. Description of the Related Art

A conventional dish washing machine includes a washing pump, a plurality of jet nozzles, and a washing water pipe to connect the washing pump to the jet nozzles, which are installed in a tub in which dishes are washed, and jet washing water of high pressure to the dishes accommodated in a dish basket to wash the dishes.

The dish washing machine further includes a level detecting unit for supplying the washing water lower than a predetermined level and a water supplying unit for supplying the washing water to the tub, for communicating the tub to the exterior, and for making equilibrium between the inner pressure of the tub and the exterior such that the dishes are washed well in the tub.

As an example of a conventional dish washing machine including the water supplying unit and the level detecting unit is disclosed in Korean Patent Laid-Open No. 10-2005-0105721.

The water supplying unit of the conventional dish washing machine includes a water passage for introducing the water into the water supplying unit, a connector for supplying the washing water passing through the water passage to a sump installed in the lower side of the tub, a flow meter disposed on the water passage to measure the flow rate of the supplied washing water, and a level detecting unit disposed in the upper side of the connector between the water passage and the connector to prevent the washing water from being supplied above a predetermined level in the tub.

The level detecting unit includes a floater elevated and lowered as the level rises and lowers in the tub, and a floater lever and a micro-switch disposed in the upper side of the floater and driven by the floater, to prevent the washing water from being supplied into the tub above a predetermined level.

Thus, when the washing water is supplied to the water supplying unit from an exterior water source, the washing water is supplied into the tub through the connector via the flow-meter and the floater along the water passage. The supplying of the washing water is stopped, when the flow-meter measures the level and it is determined that the tub is filled with an adequate quantity of the washing water.

If the flow rate of the washing water is inaccurately measured by the flow-meter so that the tub is filled with the washing water to a limit level, the floater and the floater lever ascend to drive the micro-switch so that the supplying of the washing water may be stopped.

On the other hand, dirt separated from the dishes during the washing of the dishes are attached to a connector hose for connecting the water supplying unit to the tub. Since the dirt is washed and delivered to the tub by the washing water supplied from the water supplying unit to the tub, problems such as the washing water not being smoothly supplied due to the connector hose clogged by the dirt and the floater of the lever detecting unit not being movable due to the dirt attached thereto are prevented.

However, in the conventional dish washing machine, since the level detecting unit is disposed between the water passage and the connector in the water supplying unit such that the washing water introduced into the water passage is supplied to the tub through the level detecting unit and the connector, when the water source supplies the washing water at a high pressure, the floater moves upwardly due to the water pressure and the micro-switch may malfunction though the level of the tub is lower than the limit level.

Particularly, since the floater ascends and the level detecting unit may malfunction when a large amount of the washing water passes through the connector at once via the water passage and the level detecting unit, the overall performance of the dish washing machine is deteriorated.

SUMMARY OF THE INVENTION

Accordingly, it is an aspect of the present invention to provide a dish washing machine in which water is supplied to a level detecting unit, without sudden change of a flow rate and pressure of the water from a water supplying unit to the level detecting unit such that the level detecting unit can precisely detect the level.

Additional aspects and/or advantages of the invention will be set forth in part in the description which follows and, in part, will be apparent from the description, or may be learned by practice of the invention.

The foregoing and/or other aspects of the present invention are achieved by providing a dish washing machine including a tub to hold dishes to be washed, a water supplying unit to supply water to the tub, and a level detecting unit to detect a level of water in the tub, wherein the water supplying unit includes a first guide passage to guide the water to the tub, and a second guide passage to guide the water to the level detecting unit such that a portion of the water is supplied to the level detecting unit through the second guide passage.

The water supplying unit further includes a buffering space disposed between the second guide passage and the level detecting unit such that the water flows from the water supplying unit to the level detecting unit at a predetermined flow rate.

The water supplying unit includes an introducing hole to introduce the water into the water supplying unit, a discharging hole to supply the water to the tub, and a first partition to partition the first guide passage from the second guide passage, wherein a lower end of the first partition divides the introducing hole into two parts such that the water flows into the first and second guide passages, and an upper end of the first partition is disposed to partition the buffering space from the discharging hole.

The water supplying unit extends from the buffering space to the level detecting unit such that the water supplied to the buffering space flows to the level detecting unit, and the water supplying unit further includes a connecting hole having a size through which water is discharged at a predetermined flow rate.

The water supplying unit further includes a vessel to accommodate a predetermined quantity of water, a floater disposed in the vessel, a micro-switch installed outside of the vessel, and an operating lever having a lower end positioned at the floater and an upper end positioned at the micro-switch, to turn the micro-switch on and off due the ascending and descending of the floater.

The vessel includes an introducing hole to receive the water supplied to the buffering space through the connecting hole.

The tub includes a sump installed in a lower side thereof, to collect dirt and washing water, and the vessel includes a connecting hole communicated with the sump such that the level detecting unit detects the level of the tub.

The introducing hole and the discharging hole are respectively provided in a lower end and at an intermediate portion of the water supplying unit, and the water supplying unit further includes an air hole formed in an upper end of the water supplying unit to be communicated with the discharging hole and the buffering space.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
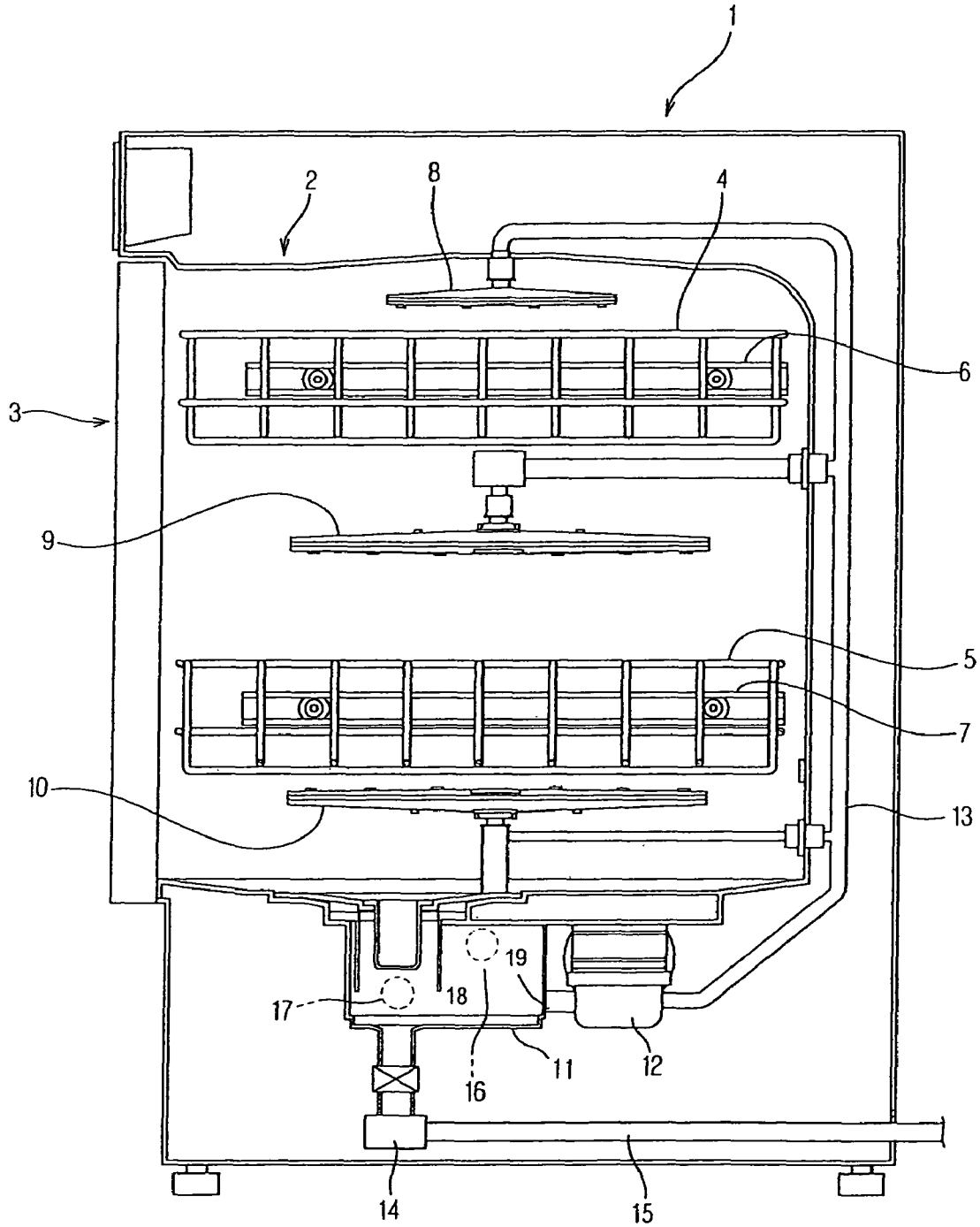
FIG. 1 is a sectional view schematically illustrating a dish washing machine according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a sectional view schematically illustrating a dish washing machine according to an embodiment of the present invention. As shown in FIG. 1, the dish washing machine according to the embodiment of the present invention comprises a housing 1 including an opening formed in a front side thereof, a front-opened tub 2 disposed in the housing 1, and a door 3 hinged to the lower side of the housing 1 to open and close opened front sides of the housing 1 and the tub 2.

In the tub 2, dish baskets 4 and 5 are installed to slide along guide rails 6 and 7 that are installed in lateral upper and lower sides of the tub 2, and a plurality of jet nozzles 8, 9, and 10 are installed to spray high-pressure washing water on the dishes accommodated in the dish baskets 4 and 5.

In the lower side of the tub 2, a sump 11 to collect the washing water and dirt, a washing pump 12 to pump the washing water in the sump 11 to the respective jet nozzles 8, 9, and 10 through a washing water pipe 13, and an exhaust pump 14 and an exhaust hose 15 to exhaust the dirt and the washing water collected in the sump 11 out of the housing 1 are installed.

The sump 11 includes a detour hole 16 to detour the washing water containing the dirt to a water supplying unit 30 (See FIG. 2) when a filter 19 of a dirt chamber 18 which is installed in the sump 11 to pass the washing water and to collect the dirt, is clogged such that there is a volume increase of the water in the dirt chamber 18, and a communication hole 17, connected to a level detecting unit 50 (See FIG. 2), to prevent the washing water from being supplied to the tub 2 over a predetermined level, to thereby detect the level of the washing water. The detour hole 16 receives and detours the washing water as the water increases within the dirt chamber 18 of the sump 11 due to the cloggage of the filter 19.

Thus, when the washing pump 12 is driven after the dishes are put in the dish baskets 4 and 5 and the tub 2 is filled with the washing water to the predetermined level, the washing water in the sump 11 is pumped to the jet nozzles 8, 9, and 10 along the washing water pipe 13 and is jetted to the dishes accommodated in the dish baskets 4 and 5. When the dishes are completely washed, the exhaust pump 14 is driven to exhaust the washing water containing dirt collected in the sump 11 out of the housing 1 through the exhaust hose 15.

Next, the water supplying unit and the level detecting unit according to an embodiment of the present invention will be described with reference to FIGS. 2-4.

Figure 2:
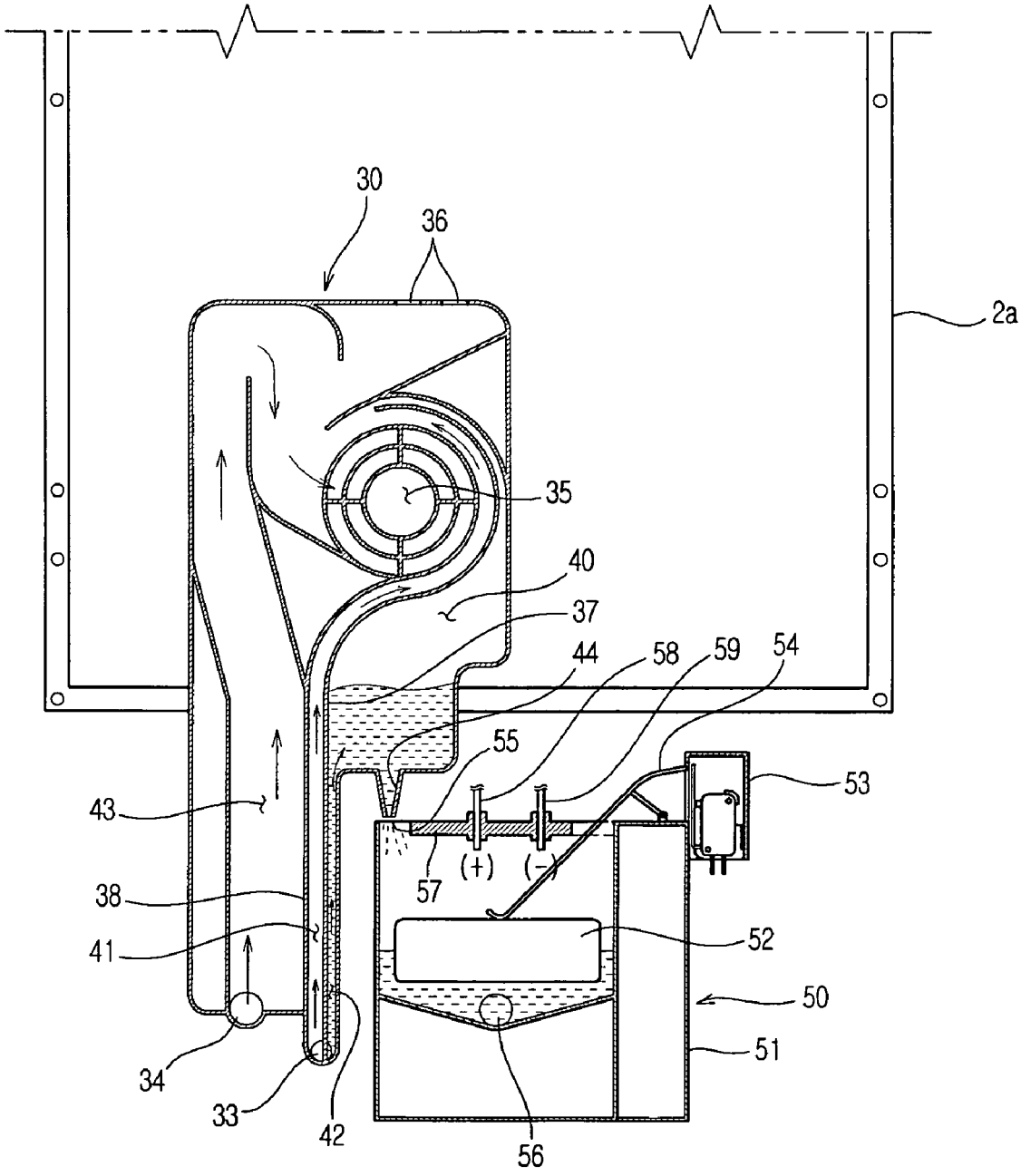
FIG. 2 is a view illustrating a water supplying unit and a level detecting unit which are attached to a side of the dish washing machine according to an embodiment of the present invention.
Figure 3:
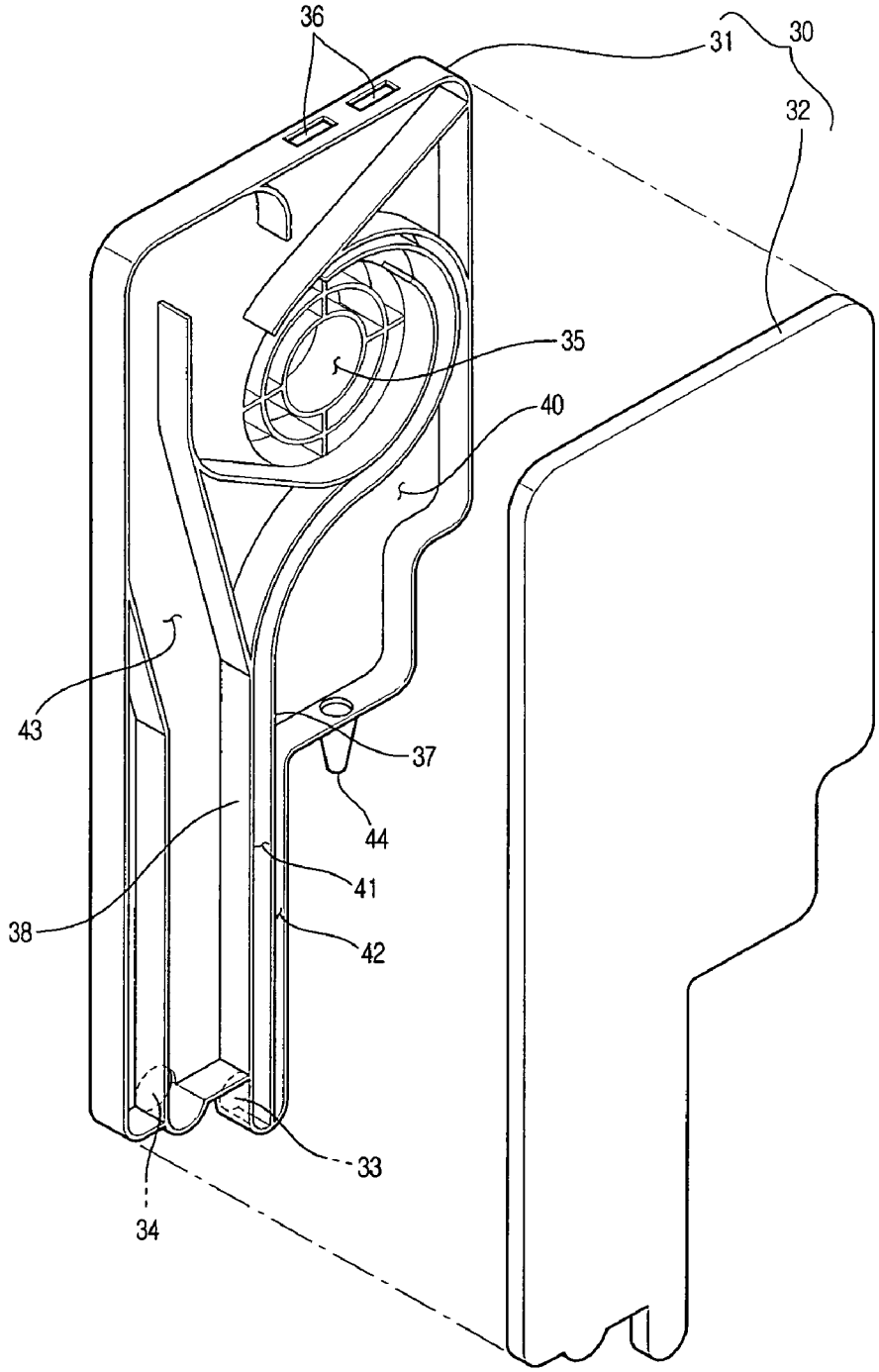
FIG. 3 is a view illustrating a detailed internal structure of the water supplying unit of the dish washing machine according to an embodiment of the present invention.

FIG. 2 is a view illustrating a water supplying unit and a level detecting unit which are attached to a side of the dish washing machine according to an embodiment of the present invention, and FIG. 3 is a view illustrating a detailed internal structure of the water supplying unit of the dish washing machine according to an embodiment of the present invention.

A water supplying unit 30 is installed on an outside of a side plate 2*a* of the tub, to supply the washing water to the tub 2 and to allow air to flow therethrough, such that the inner pressure of the tub 2 is in equilibrium with an outer condition thereof, and a level detecting unit 50 is installed to prevent the washing water from being supplied to the tub 2 over the predetermined level.

As shown in FIG. 3, the water supplying unit 30 comprises a base member 31 in which a buffering space 40 is formed to allow the washing water introduced into the water supplying unit 30 to flow without sudden change of the flow rate and pressure to the level detecting unit 50, and a cover 32 to cover the base member 31.

In the lower end of the base member 31, an introducing hole 33 is formed to introduce the washing water into the water supplying unit 30, a detour hole 34 is formed to detour the washing water containing the dirt to the water supplying unit 30 such that pressure of the dirt chamber does not increase due to the clogged dirt chamber of the sump 11, and a discharging hole 35 is formed near a central area of the base member 31, to supply the washing water to the tub 2 and to allow air to flow therethrough.

Air holes 36 are formed in an upper side of the base member 31, such that air enters the tub 2 through the air holes 36 and air or water vapor is discharged from the tub 2 through the discharge hole 35.

The base member 31 further comprises a first partition 37 to partition the buffering space 40 from the discharging hole 35, and a second partition 38 to partition the introducing hole 33 from the detour hole 34.

In the first partition 37, a lower end thereof extends to a lower end of the base member 31, to divide the introducing hole 33 into two parts, and an upper end thereof extends above the discharging hole 35 such that the washing water introduced into the water supplying unit 30 from the water source through the introducing hole 33 is divided into two parts to flow into the discharging hole 35 and the buffering space 40.

A first guide passage 41 connects the introducing hole 33 to the discharging hole 35 by the first partition 37, and a second guide passage 42 connects the introducing hole 33 to the buffering space 40.

Since a large amount of the washing water is not required to flow into the buffering space 40, the first partition 37 leans toward the buffering space 40 and divides the introducing hole 33, such that a quantity of the washing water flowing into the discharging hole 35 is greater than that which flows into the buffering space 40.

Accordingly, the buffering space 40 is partitioned from the discharging hole 35 between the introducing hole 33 and the discharging hole 35 by the first partition 37, to accommodate a predetermined quantity of the washing water introduced through the introducing hole 33 and to make the washing water flow slowly to the level detecting unit 50. Thus, in the present invention, the quantity of the washing water is not suddenly increased in the level detecting unit 50, such that the level detecting unit 50 is not operated by the supplied washing water but instead precisely detects the level of the washing water in the tub 2.

A portion of the washing water introduced into the water supplying unit 30 flows into the level detecting unit 50 in order to wash between the level detecting unit 50 and the sump 11 and a connector hose 62 (See FIG. 4) with clean water, to thereby prevent the level detecting unit 50 from being inoperable or the connector hose 62 which connects the level detecting unit 50 to the sump 11 from being clogged, due to the dirt, which enters the level detecting unit 50, together with the washing water collected in the sump 11, during the washing of the dishes and which remains after the washing of the dishes, and which is stuck between the level detecting unit 50 and the sump 11, because the level detecting unit 50 is communicated with the sump 11 to detect the level of washing water in the tub 2.

In the second partition 38, a lower end thereof extends upwardly from the lower end of the base member 31, and an upper end thereof extends over the upper side of the discharging hole 35 and is separated from the upper side of the base member 31, to connect the detour hole 34 to the discharging hole 35 and to separate the detour hole 34 from the introducing hole 33.

Thus, the first guide passage 41 is formed between the first partition 37 and the second partition 38, and a third guide passage 43 is formed between the second partition 38 and a side of the base member 31, to connect the detour hole 34 to the discharging hole 35.

The first guide passage 41 and the third guide passage 43, and the second guide passage 42 and the buffering space 40 are communicated with the air holes 36 formed in the upper side of the base member 31.

In the lower end of the buffering space 40, a connecting hole 44 protrudes downwardly such that the washing water contemporarily accommodated in the buffering space 40 flows to the level detecting unit 50 at a predetermined flow rate through the connecting hole 44.

When the cover 32 is coupled with the base member 31, the water supplying unit 30 comprises a closed chamber in which the introducing hole 33, the detour hole 34, the connecting hole 44, and the air holes 36 are communicated with an inside of the housing 1, and the discharging hole 35 is communicated with the tub 2.

The level detecting unit 50 includes a vessel 51 having a chamber to detect the level of washing water, a floater 52 disposed in the vessel 51 to ascend and descend due to water supplied to the vessel 51, a micro-switch 53 installed at an upper outside of the vessel 51 to be operated, when the washing water in the tub 2 reaches a predetermined level, and an operating lever 54 whose upper end is positioned above the floater 52 at the micro-switch 53 to turn the micro-switch 53 on or off due to the ascending and descending of the floater 52.

In the upper side of the vessel 51, an introducing hole 55 is formed and connected with the connecting hole 44 formed in the lower end of the buffering space 40 of the water supplying unit 30 such that the washing water in the buffering space 40 can flow into the vessel 51. In a side of the vessel 51, a connecting hole 56 is formed and communicated with a lower end of the sump 11 installed in the tub 2 such that the washing water enters the tub 2 through the discharging hole 35 of the water supplying unit 30, is collected in the sump 11 again and is sent to the vessel 51 through the connector hose 62 again in order to enable the level detecting unit 50 to detect the level of the washing water.

Although the connecting hole 44 of the buffering space 40 is separated from the introducing hole 55 of the vessel 51 shown in FIG. 2, alternatively, the connecting hole 44 may be coupled with the introducing hole 55. That is, although not depicted in the drawings, in order to reduce the manufacturing process and to prevent the water in the vessel 51 from overflowing through the introducing hole 55 out of the vessel 51, the vessel 51 of the level detecting unit 50 may be integrally formed with the water supplying unit 30.

An electrode sensor 57 having a positive electrode 58 and a negative electrode 59 is installed in an upper side of the vessel 51. When any one of the operating lever 54 of the floater 52 and the micro-switch 53 is not operated so that the level of the washing water in the tub 2 is not detected, the positive electrode 58 is electrically connected to the negative electrode 59 due to the water filled in the vessel 51 so that the electrode sensor 57 works to prevent the washing water from being excessively supplied to the tub 2.

Since the level detecting unit 50 is communicated with the water supplying unit 30 via the buffering space 40 and with the sump 11 via the connector hose 62, the vessel 51, the floater 52, and the connector hose 62 are washed by clean water introduced from the buffering space 40 such that dirt attached to the vessel 51, the floater 52, and the connector hose 62 is sent to the sump 11.

The above-described washing process prevents the connector hose 62 from being clogged and the dirt from attaching and sticking the floater 52 causing the floater 52 to not move.

Figure 4:
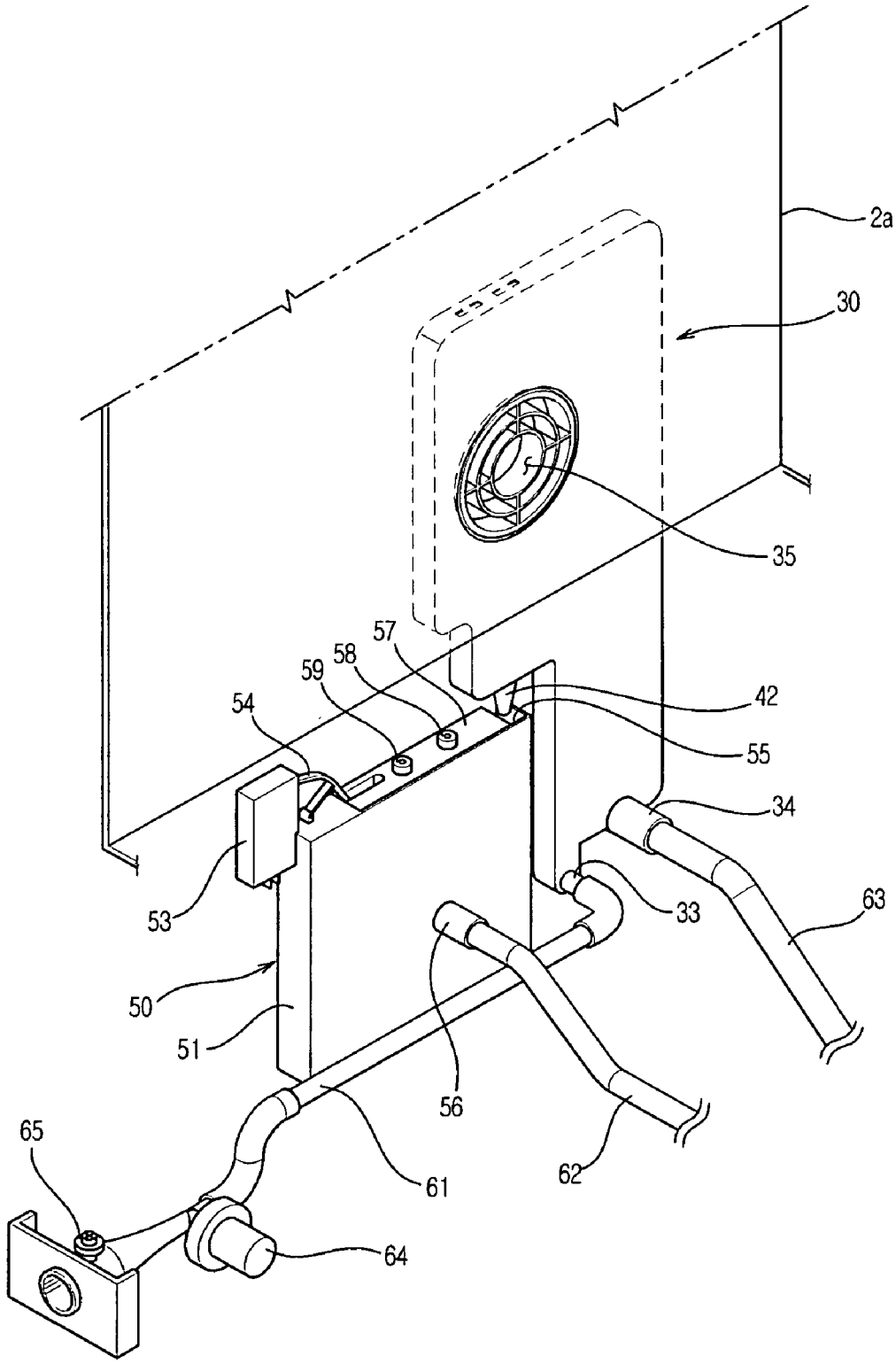
FIG. 4 is a view illustrating a water supplying hose connected with the water supplying unit and a connector hose connected with the level detecting unit.

FIG. 4 is a view illustrating a water supplying hose connected to the water supplying unit and a connector hose connected to the level detecting unit, according to an embodiment of the present invention.

As shown in FIG. 4, the water supplying hose 61 which is connected to an external water source (not shown) is inserted into the introducing hole 33 formed in the lower end of the water supplying unit 30 such that the washing water can be introduced into the water supplying unit 30.

The water supplying hose 61 comprises a flow-meter 64 to measure a flow rate of the washing water supplied from the external water source and a valve 65 to open and close the water supplying hose 61 to thereby supply the washing water to the tub 2 or to intercept the washing water supplied to the tub 2.

A detour hose 63 and a connector hose 62, which are respectively connected with the detour hole 16 and the connecting hole 17 formed in the sump 11 (See FIG. 1), are inserted into the detour hole 34 formed in the lower end of the water supplying unit 30 and the connecting hole 56 formed in the intermediate portion of the level detecting unit 50 so that the water supplying unit 30 and the level detecting unit 50 are communicated with the sump 11.

Operations of the water supplying unit 30 and the level detecting unit 50 will be described in detail below.

Firstly, when the valve 65 installed on the water supplying hose 61 is opened to supply an predetermined quantity of the washing water at a predetermined flow rate to the tub to wash the dishes, the washing water is introduced into the water supplying unit 30 through the water supplying hose 61 and the introducing hole 33.

The majority of the washing water introduced into the water supplying unit 30 ascends along the first guide passage 41 to be supplied into the tub 2 through the discharging hole 35, and some of the washing water flows into the buffering space 40 along the second guide passage 42.

The buffering space 40 gradually feeds water to the level detecting unit 50 such that high-pressure washing water introduced into the water supplying unit 30 is not directly delivered to the level detecting unit 50. By doing so, although the flow rate and pressure of the washing water supplied from the water source are changed, the floater 52 and the operating lever 54 can work steadily in relation to the level of washing water in the tub 2, without malfunction due to the washing water.

The washing water flowing into the buffering space 40 is sent to the vessel 51 of the level detecting unit 50 through the connecting hole 44 and the introducing hole 55, and exits to the connector hose 62 through the connecting hole 56 of the vessel 51, to push the dirt remaining in the vessel 51 and the connector hose 62 to the sump 11.

When the connector hose 62 is washed with the clean water before the washing water is introduced into the vessel 51 of the level detecting unit 50 from the sump 11, the floater 52 is prevented from being fixed by the dirt and the connector hose 62 is prevented from being be clogged so that the level detecting unit 50 can precisely detect the level of the tub 2.

When a predetermined time has elapsed, the washing water supplied into the tub 2 is collected in the sump 11, the level of the washing water in tub 2 ascends, and the washing water in the sump 11 is introduced into the vessel 51 through the connector hose 62 due to the ascending of the level of the tub 2, such that the floater 52 ascends.

When the washing water is supplied to a predetermined level in the tub 2, the floater 52 lifts the operating lever 54 to operate the micro-switch 53 due to the operating lever 54, to stop the supplying of the washing water.

If either of the floater 52, the micro-switch 53, and the operating lever 54 malfunctions and the washing water is filled to the upper side of the vessel 51, the positive electrode 58 and the negative electrode 59, submerged in the washing water, are electrically connected such that the electrode sensor 57 works, thereby detecting the washing water supplied to a limit level of the tub 2 and preventing the washing water from overflowing from the tub 2.

When the tub 2 is filled with the washing water to the predetermined level and the washing of the dishes is started, the dirt separated from the dishes is accumulated in the sump 11, and, as described above, the dirt chamber of the sump 11 may be clogged by the dirt thereby increasing the inner pressure thereof.

Therefore, the washing water containing the dirt is introduced into the water supplying unit 30 from the dirt chamber through the detour hose 63 and the detour hole 34 and is detoured to the tub 2 through the discharging hole 35 so that the inner pressure of the dirt chamber is lowered and the washing of the dishes is performed in a normal manner.

Moreover, when the inner pressure of the tub 2 is lowered due to the operation of the washing pump 12 or increased due to hot water vapor by using hot washing water, air is supplied to or discharged from the tub 2 through the air holes 36 of the water supplying unit 30 so that the tub 2 can be maintained at a predetermined pressure.

As described above, since the dish washing machine according to an embodiment of the present invention has a structure in which the majority of water introduced into the water supplying unit through the introducing hole is supplied to the tub through the discharging hole and a portion of the water is supplied to the level detecting unit through the buffering space without sudden change of the flow rate and pressure of the water, the level detecting unit does not malfunction due to a sudden change of the flow rate and pressure of the water, and the level detecting unit can precisely detect the level of washing water in the tub. Therefore, the performance of the dish washing machine is enhanced.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A dish washing machine, comprising:

a tub to wash dishes therein;

a sump installed in a lower side of the tub to separate dirt from the dishes;

a water supplying unit to supply water to the tub; and a level detecting unit fluidly connected with the sump to detect a level of water in the tub, to prevent the water from being supplied to the tub over a predetermined level, wherein the water supplying unit comprises:

an introducing hole to introduce the water into the water supplying unit, a discharging hole to supply the water to the tub, a first guide passage to guide the water to the discharging hole such that a portion of the water introduced to the water supplying unit is supplied to the discharging hole through the first guide passage, a second guide passage to guide the water to the level detecting unit such that a portion of the water introduced to the water supplying unit is supplied to the level detecting unit through the second guide passage, a buffering space disposed between the second guide passage and the level detecting unit to allow the water to flow without sudden change of a flow rate and a pressure to the level detecting unit, and a connecting hole of a predetermined size through which water from the buffering space is discharged at a predetermined flow rate to the level detecting unit, wherein the buffering space of the water supplying unit is positioned over the level detecting unit such that the water supplied to the buffering space flows through the connecting hole to the level detecting unit by gravity.

2. The dish washing machine according to claim 1, wherein the level detecting unit comprises:

a vessel to receive water from the buffering space through the connecting hole of the water supplying unit at a predetermined flow rate;

a floater disposed in the vessel to ascend and descend due to water supplied to the vessel;

a micro-switch installed outside of the vessel to operate when the water in the tub reaches the predetermined level; and an operating lever having a lower end positioned at the floater and an upper end positioned at the micro-switch, to turn the micro-switch on and off due to the ascending and descending of the floater.

3. The dish washing machine according to claim 2, wherein the vessel comprises an introducing hole to receive the water flowing from the connecting hole.

4. The dish washing machine according to claim 3, wherein the vessel comprises a connecting hole communicated with the sump such that the level detecting unit detects the level of water in the tub.

5. The dish washing machine according to claim 1, wherein the introducing hole and the discharging hole are respectively provided in a lower end and at an intermediate portion of the water supplying unit, and the water supplying unit comprises an air hole formed in an upper end of the water supplying unit to be communicated with the discharging hole and the buffering space.

* * * * *